United States Patent [19]

Zettier

[11] Patent Number: 4,695,270

[45] Date of Patent: Sep. 22, 1987

[54] DRUM FOR CLARIFYING AND SEPARATING CENTRIFUGATES

[75] Inventor: Karl-Heinz Zettier, Oelde, Fed. Rep. of Germany

[73] Assignee: Westfalia Separator AG, Oelde, Fed. Rep. of Germany

[21] Appl. No.: 823,707

[22] Filed: Jan. 29, 1986

[30] Foreign Application Priority Data

Feb. 2, 1985 [DE] Fed. Rep. of Germany ..... 3503581

[51] Int. Cl.[4] ..... E04E 11/00

[52] U.S. Cl. ..... 494/34; 210/360.1; 210/374; 210/380.1; 494/44; 494/56; 494/69; 494/70; 494/73; 494/74

[58] Field of Search ..... 210/360.1, 360.2, 363, 210/364, 365–367, 369, 380.1, 371, 374; 494/31, 34, 43, 44, 56, 57, 61, 55, 58, 59, 67, 68, 69, 70, 73, 74, 85

[56] References Cited

U.S. PATENT DOCUMENTS 4,305,817 12/1981 Kohlsette ..... 210/371

*Primary Examiner*—Frank Sever

*Attorney, Agent, or Firm*—Sprung Horn Kramer & Woods

[57] ABSTRACT

A drum for clarifying and separating centrifugates. It has at least one skimmer for diverting the clarified or separated centrifugates, a stationary inlet pipe extending into an inlet chamber, which rotates along with the drum, through an aperture that is slightly wider than the inlet pipe, outlets extending from the inlet chamber into a vestibule that communicates with channels ascending through a set of nested plates within the drum, and, upstream of the inlet chamber, an annular space that communicates with the inlet chamber through an annular channel. To provide simple means of improving the inlet conditions to the extent that the drum will be able to withstand greater supply fluctuations with no injector effect where the inlet pipe enters the inlet chamber, a skimming disk with runoff apertures on the bottom in the vicinity of the inlet chamber is fastened to the inlet pipe and positioned in the annular space in such a way that centrifugate can be returned to the inlet chamber through the runoff apertures and the annular channel.

8 Claims, 3 Drawing Figures

DRUM FOR CLARIFYING AND SEPARATING CENTRIFUGATES

BACKGROUND OF THE INVENTION

The present invention relates to a drum for clarifying and separating centrifugates, with at least one skimmer for diverting the clarified or separated centrifugates, with a stationary inlet pipe extending into an inlet chamber, which rotates along with the drum, through an aperture that is slightly wider than the inlet pipe, with outlets extending from the inlet chamber into a vestibule that communicates with channels ascending through a set of nested plates within the drum, and with, upstream of the inlet chamber, an annular space that communicates with the inlet chamber through an annular channel.

A drum of this type is known, for example, from German Pat. No. 3 019 737. The centrifugate can be gently supplied to the rotating inlet chamber in the distributor because the inlet chamber is kept extensively full of centrifugate. This entails, however, precisely adjusting the drum to the particular rate of supply desired. If the rate of supply increases during operation, the inlet chamber will overflow. Some of the overflowing centrifugate can be intercepted by the annular space communicating with and upstream of the inlet chamber returned to the centrifuging space through channels that extend from the annular space. If the suction capacity of the channels is exceeded, however, some of the overflow will enter the skimming chamber of the skimmer, where it will have a deleterious effect on the light phase of the centrifugate.

If the inlet chamber is not full enough to overflow, an injector effect can occur at the exit of the inlet pipe and lead to bursting of the particles of fat in the milk or of other particles in whatever suspension constitutes the centrifugate.

SUMMARY OF THE INVENTION

The object of the present invention is to provide simple means of improving the inlet conditions in a drum of the aforesaid type to the extent that it will be able to withstand greater supply fluctuations with no injector effect where the inlet pipe enters the inlet chamber.

This object can be attained in accordance with the invention if a skimming disk with runoff apertures on the bottom in the vicinity of the inlet chamber is fastened to the inlet pipe and positioned in the annular space in such a way that centrifugate can be returned to the inlet chamber through the runoff apertures and the annular channel.

Some of the centrifugate that enters the annular space will accordingly be returned to the inlet chamber through the channels in the skimming disk. As soon as the capacity of the channels is exhausted, the annular space will fill up and the skimming disk, which is immersed in the centrifugate will convey the centrifugate back into the inlet chamber. The inlet pipe can be in one piece with the skimming disk.

The conveyor action of the skimming disk in the annular space can be augmented if a distributor that demarcates three sides of the annular space has ribs that act on the centrifugate above the skimming disk in the top of the annular space. The ribs improve entrainment of centrifugate within the annular space, increasing the pressure of the centrifugate against the skimmming disk.

This measure also subjects the centrifugate leaving the outlets in the skimming disk positioned in the annular space and flowing back into the inlet chamber through the annular channel, to higher pressure than the centrifugate being supplied to the inlet chamber through the inlet pipe. The level of pressure on the centrifugate being returned to the inlet chamber by the skimming disk can be set by appropriate choice of the dimensions of the ribs that act on the centrifugate in the annular space.

Returning part of the centrifugate from the annular space in the vicinity of the outer surface of the inlet pipe eliminates any injector effect in the vicinity of the bottom of the pipe due to the centrifugate that is being supplied through the inlet pipe.

The top of the distributor can have an accommodation for a ring that surrounds but does not touch the inlet pipe and that the ribs, which extend radially, can be fastened to the lower surface of the ring. The ring can be fastened to the distributor with screws. Moreover, the ribs can be in one piece with the ring.

In one embodiment of the drum, having an annular space that communicates with the centrifuging space through channels in the distributor that extend from the bottom surface of the annular space, the channel apertures in the bottom surface of the annular space are partly covered by a plate that, in conjunction with the inlet pipe, demarcates the annular channel.

A bore that communicates with the atmosphere can be positioned in the skimming disk to divert the light phase of the centrifugate to maintain atmospheric pressure in the upper section of the annular space, the section that is free of centrifugate.

Some preferred embodiments of the invention will now be described with reference to the attached drawings, wherein

DETAILED DESCRIPTION OF THE PREFERRED EMBODIMENTS

Figure 1:
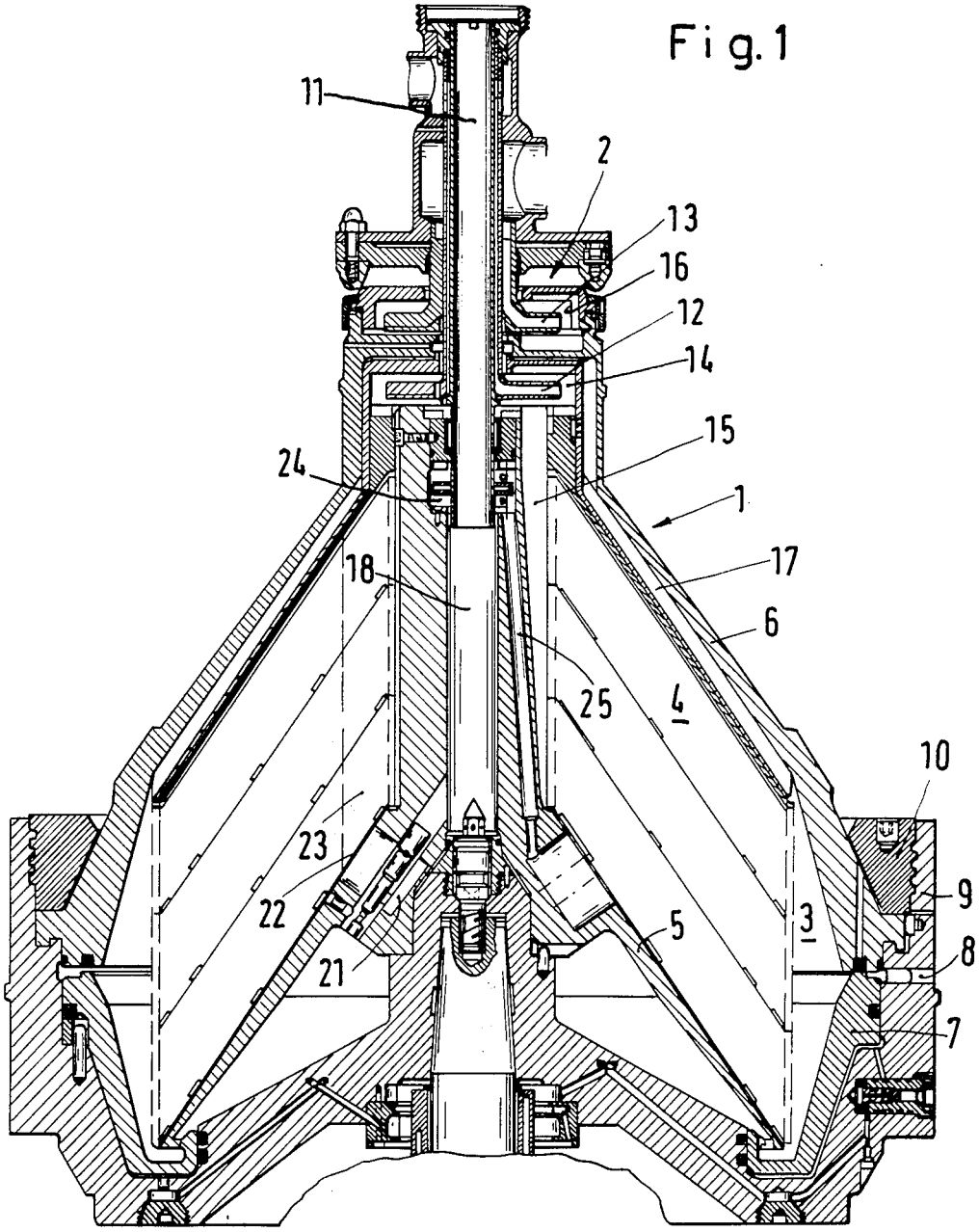
FIG. 1 is a vertical section through a drum in accordance with the invention.

The self-emptying rotating drum 1 illustrated in FIG. 1 has a skimmer 2 that is stationary in operation in the vicinity of its inlet. The drum also has a solids space 3 and a separation space consisting of a set of several nested plates 4 resting on a distributor 5. The separation and solids spaces are demarcated at the top by a drum cover 6 and at the bottom by an axially moving piston slide 7 that opens and closes solids-extraction outlets 8 in an adjacent drum jacket 9 when the centrifuge is in operation. The jacket and cover are held together by a sealing ring 10.

In the vicinity of skimmer 2 is a central inlet pipe 11, to which are attached a lower skimming disk 12 that diverts the specifically lighter phase of the centrifugate and an upper skimming disk 13 that diverts the specifically heavier phase. Lower skimming disk 12 is accommodated in a skimming chamber 14 and communicates with the separation space through channels 15. Upper skimming disk 13 is accommodated in a skimming chamber 16 and communicates with the separation space through a channel 17 between nested plates 4 and drum cover 6. Inlet pipe 11 extends through a cylindrical and unribbed inlet chamber 18 within distributor 5. The inside diameter of inlet chamber 18 is about 1.4 times as long as the inside diameter of inlet pipe 11. Outlets 20 extend from the bottom of inlet chamber 18 and are at least three times the inside diameter of inlet chamber 18 away from the outlet of inlet pipe 11. The total cross-section of outlets 20 is smaller than that of inlet chamber 18 and larger than that of inlet pipe 11. Outlets 20 empty into a antechamber 21 that communicates with ascending channels 23 in nested plates 4 through apertures 22 in the foot of distributor 5. Antechamber 21 also communicates with an annular space 24 upstream of inlet chamber 18 through channels 25.

Figure 2:
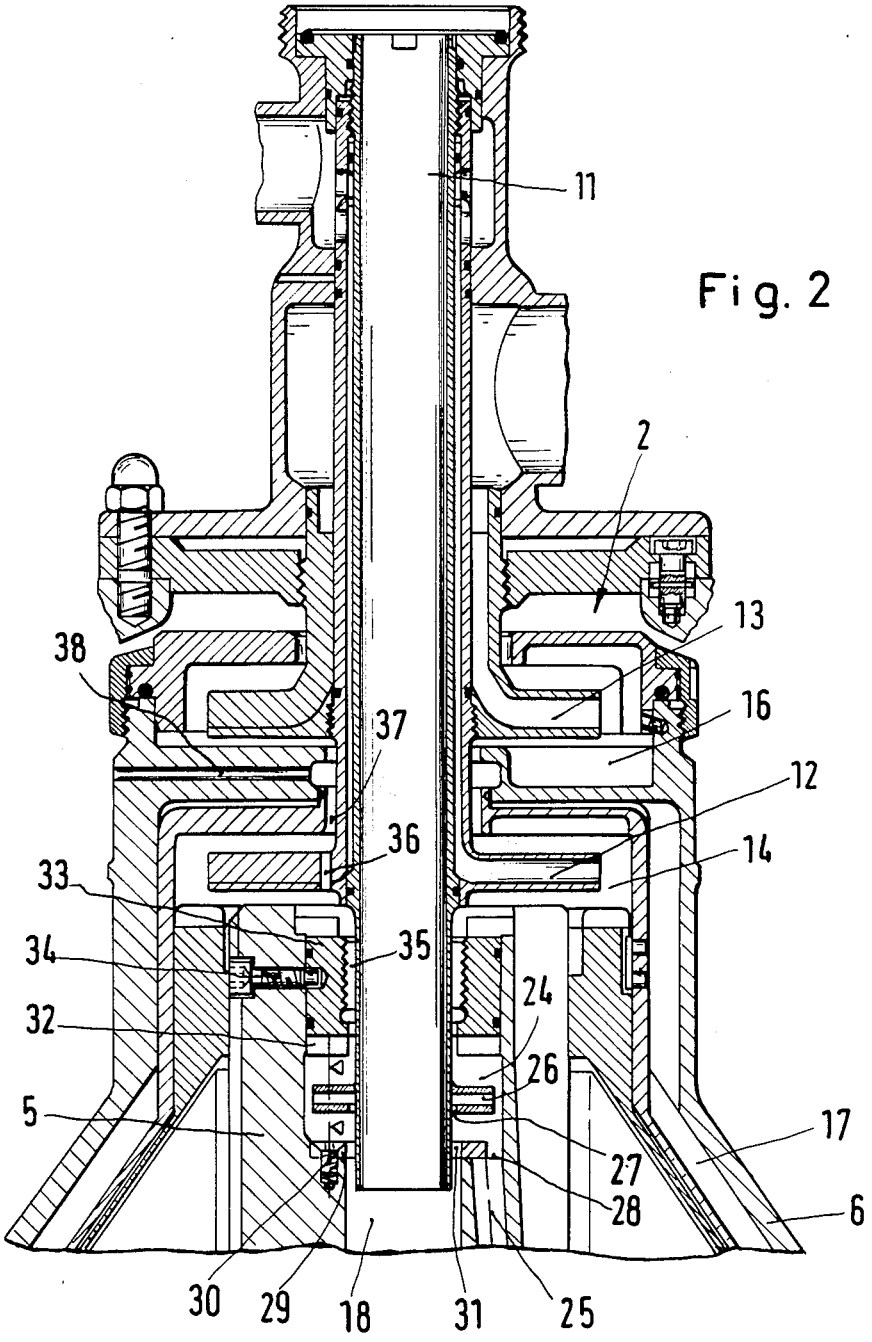
FIG. 2 is a larger-scale detail of the upper part of the drum illustrated in FIG. 1.

A stationary skimming disk 26 is accommodated in annular space 24 and has runoff apertures 27 in the bottom adjacent to inlet pipe 11 as shown in FIG. 2. Inlet pipe 11 can be in one piece with skimming disk 26.

The channel apertures 28 in the floor of annular space 24 are partly covered by a plate 29 that is fastened to distributor 5 with screws 30. Plate 29 demarcates in conjunction with inlet pipe 11 an annular channel 31 through which the centrifugate can flow from inlet chamber 18 into annular space 24, with part of the centrifugate being returned to inlet chamber 18 through skimming disk 26.

The surface structure of plate 29, which rotates along with distributor 5, determines the effect of the plate on the centrifugate in annular space 24, specifically in the area between plate 29 and skimming disk 26. The more intensively the surface structure of plate 29 acts on the centrifugate in that area of annular space 24, the higher the liquid pressure established in the area when the centrifuge is in operation.

In the illustrated embodiment, distributor 5, which demarcates annular space 24 on three sides, has ribs 32 above skimming disk 26 that affect the centrifugate in the upper section of the annular space.

The ribs 32 in the illustrated embodiment are in one piece with a ring 33 that is fastened to distributor 5 with screws 34. Ring 33 surrounds but does not touch inlet pipe 11, leaving an annular channel 35 between the pipe and ring 33.

Ribs 32 are positioned radially on ring 33. Ribs 32 operate in conjunction with the centrifugate in the vicinity of annular space 24 to establish a relatively high liquid pressure.

A bore 36 that communicates with the atmosphere is positioned in the skimming disk 12 that diverts the light phase of the centrifugate. Bore 36 maintains atmospheric pressure in the upper section of the annular space 24, the section that is free of centrifugate.

Figure 3:
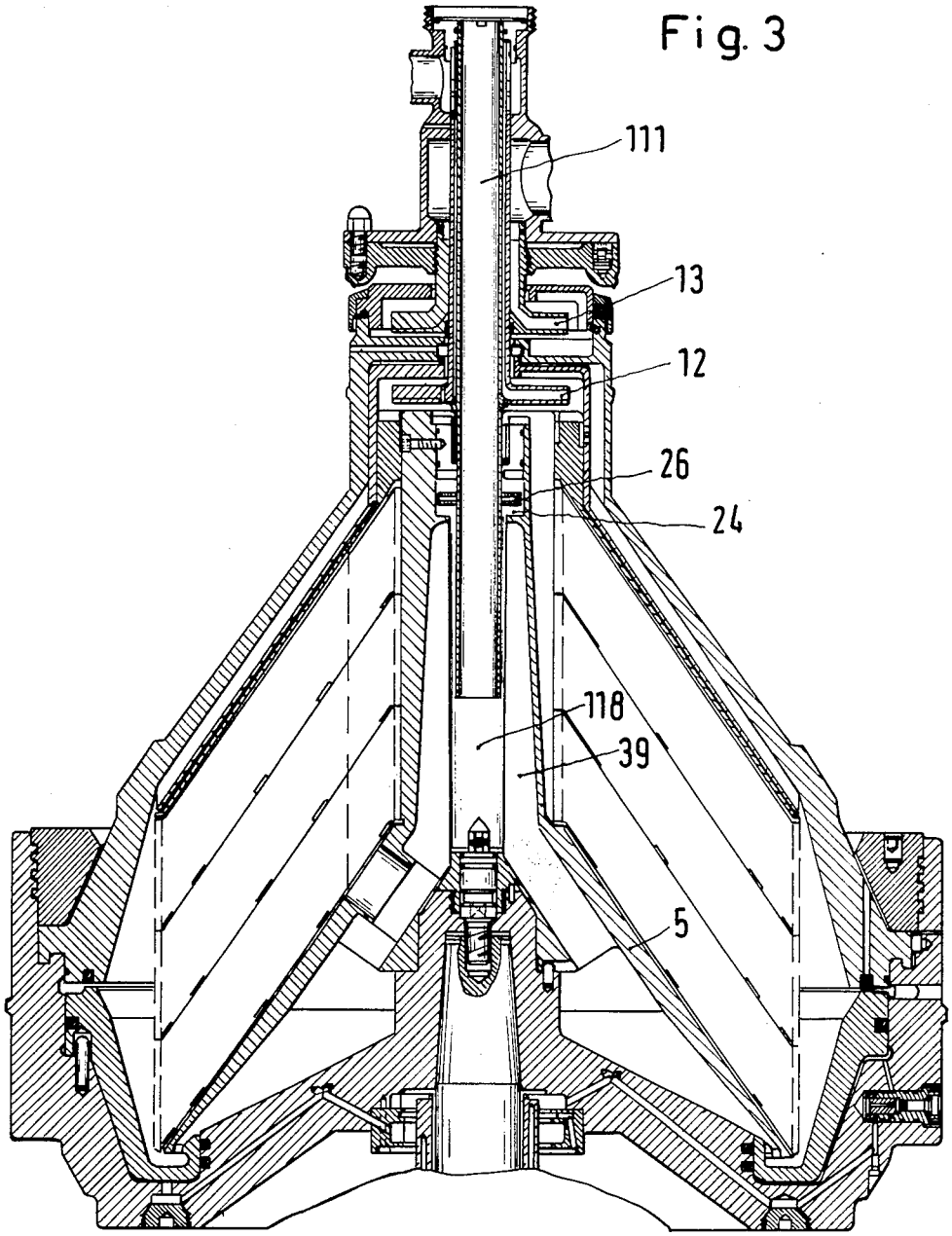
FIG. 3 is a vertical section through another embodiment of a drum in accordance with the invention.

The inlet pipe 111 in the embodiment illustrated in FIG. 3 extends relatively far into an inlet chamber 118 that is demarcated by ribs 39 on distributor 5.

This embodiment also has annular space 24 upstream of inlet chamber 118 that accommodates skimming disk 26 fastened to inlet pipe 111.

It will be appreciated that the instant specification and claims are set forth by way of illustration and not limitation, and that various modifications and changes may be made without departing from the spirit and scope of the present invention.

What is claimed is:

1. In a device for clarifying and separating centrifugates, having a rotatable drum, a stationary inlet pipe extending into an inlet chamber and which rotates along with the drum, at least one skimmer for diverting the clarified or separated centrifugates, through an aperture that is wider than the inlet pipe, outlets extending from the inlet chamber into an antechamber that communicates with channels ascending through a set of nested plates within the drum and an annular space upstream of the inlet chamber and that communicates with the inlet chamber through an annular channel, the improvement comprising: means for precluding an injector effect where the inlet pipe enters the inlet chamber sufficient to enable maximum tolerance to withstand greater supply fluctuations including a skimming disk with runoff apertures on the bottom thereof in the vicinity of the inlet chamber and fixed to the inlet pipe, the skimming disk positioned in the annular sapce to return centrifugate to the inlet chamber through the runoff apertures and the annular channel.

2. The device as in claim 1, wherein the inlet pipe is in one piece with the skimming disk.

3. The device as in claim 1, further comprising a distributor that demarcates three sides of the annular space and ribs acting on the centrifugate above the skimming disk in the top of the annular space.

4. The device as in claim 3, wherein the top of the distributor has means mounting a ring that surrounds without touching the inlet pipe and wherein the ribs extend radially and are fastened to the lower surface of the ring.

5. The device as in claim 4, wherein the means mounting the ring the means mounting on the distributor comprises screws.

6. The device as in claim 4, wherein the ribs are in one piece with the ring.

7. The device as in claim 1, further comprising a distributor which demarcates three sides of the annular space and wherein the annular space communicates with a centrifuging space in the drum through channels in the distributor that extend from channel aperture in the bottom surface of the annular space, wherein the channel apertures in the bottom surface of the annular space are partly covered by a plate in conjunction with the inlet pipe demarcates the annular channel.

8. The device as in claim 1, wherein the skimmer includes a second skimmer disc for the lighter phase having a perforation that communicates with the atmosphere to maintain atmospheric pressure in the upper section of the annular space that is free of centrifugate.

* * * * *